US007255615B2

(12) United States Patent
Woelfl et al.

(10) Patent No.: US 7,255,615 B2
(45) Date of Patent: Aug. 14, 2007

(54) RADIALLY DISPLACEABLE CONNECTOR AND SOCKET

(75) Inventors: Kurt Woelfl, Mühldorf am Inn (DE); Thomas Appinger, Haunersdorf (DE); Stefan Franzl, Töging Inn (DE); Fred Mangstl, Neumarkt St. Veit (DE); Gerhard Nicklbauer, Mühldorf (DE); Wolfgang Jacobi, München (DE)

(73) Assignee: ODU Steckverbindungssysteme GmbH & Co. KG, Muhldorf (DE)

( * ) Notice: Subject to any disclaimer, the term of this patent is extended or adjusted under 35 U.S.C. 154(b) by 0 days.

(21) Appl. No.: 11/267,014

(22) Filed: Nov. 4, 2005

(65) Prior Publication Data

US 2006/0094307 A1 May 4, 2006

(30) Foreign Application Priority Data

Nov. 4, 2004 (DE) ..... 10 2004 053 332
Sep. 16, 2005 (EP) ..... 05020269

(51) Int. Cl.
*H01R 13/11* (2006.01)

(52) U.S. Cl. ..... 439/857

(58) Field of Classification Search ..... 439/857, 439/851–856, 842, 845, 843, 70; 29/876
See application file for complete search history.

(56) References Cited

U.S. PATENT DOCUMENTS 3,127,492 A * 3/1964 Date ..... 200/258
3,912,352 A * 10/1975 Kinnear ..... 439/13
4,106,839 A 8/1978 Cooper
4,423,917 A 1/1984 Scheingold
4,540,235 A * 9/1985 Lolic ..... 439/839
5,035,661 A * 7/1991 Steinhardt et al. ..... 439/839
5,645,458 A * 7/1997 Hotea ..... 439/852
6,902,413 B1 * 6/2005 Moga ..... 439/125

FOREIGN PATENT DOCUMENTS

| | | |
|---|---|---|
| CH | 323737 A | 8/1957 |
| DE | 530411 C | 7/1931 |
| DE | 1041559 B | 10/1958 |
| DE | 1042137 B | 10/1958 |
| DE | 1071799 B | 12/1959 |
| DE | 3740223 A1 | 6/1989 |
| DE | 196 09 367 A1 | 9/1997 |
| DE | 198 16 695 A1 | 10/1998 |
| DE | 197 18 448 A1 | 11/1998 |
| EP | 1 119 077 A1 | 7/2001 |
| WO | WO 03/077372 A1 | 9/2003 |

* cited by examiner

*Primary Examiner*—Alexander Gilman
(74) *Attorney, Agent, or Firm*—Schwabe Williamson & Wyatt

(57) ABSTRACT

The present invention describes a socket of an electrical connector having at least one contact element. The contact element has a first end region, a contact area for electrical contact with a plug and a second end region. The first and/or the second end region according to the present invention is/are displaceable in the radial direction.

12 Claims, 4 Drawing Sheets

RADIALLY DISPLACEABLE CONNECTOR AND SOCKET

TECHNICAL FIELD

The present invention relates to a socket of an electrical connector. More specifically, the present invention relates to a socket configured to receive a plug, the socket having at least one contact element with a first end region, a contact area for electrical contact with the plug, and a second end region.

BACKGROUND

Electrical connectors of the aforementioned type are known, and generally involve plug-socket combinations. In the known sockets, the contact elements are usually designed in the form of segments extending in a curved fashion. If a plug is inserted into the socket, the plug comes in contact with the apex of the curved contact element. The dimensions are selected in such a manner that the plug deforms the segment by flattening the curve against an elastic reset force of the segment. Consequently, the segment is pressed in the radial direction against the plug using the said elastic reset force. If the plug is displaced inside the socket in a direction that is transverse to the direction of insertion, there will be at least one segment on which a lesser deformation force acts, due to which the pressing force is also reduced. Larger displacements of the plug inside the socket lead to the segment being lifted completely off the plug surfaces.

SUMMARY OF INVENTION

Embodiments of the electrical connector refine the socket of the aforementioned type in such a manner that sufficient contact force is maintained with a plug even during a transversal displacement of the plug inside the socket. Accordingly, this desired result may be achieved in at least one embodiment of the socket of the electrical connector by the displacement of the first and/or the second end region of at least one contact element in the radial direction. The displacement of at least one end region of the contact element inside the socket enables the contact element to follow the plug during transversal displacement and to maintain an appropriate reset force so as to ensure a sufficient contact at all times between the plug and the contact element of the socket. The electric connector to a large extent is symmetrically charged.

According to one embodiment of the present invention, the first end region may be fixably attached to a support of the socket. In other words, in this embodiment of the socket, the second end region of the contact element follows the plug during a transversal displacement of the latter, whereas the attachment of the first end region provides that the support serves as a counter-bearing with respect to the elastic reset force contacting the contact element on the plug.

According to one embodiment of the present invention, the contact element is preferably V-shaped. At this point it may be emphasized that the "V" shape may not be provided with a very pointed design, although it may. Even the two sidepieces of the "V" may not be straight, although at least one sidepiece may also be straight. Instead, the sidepieces may also extend in a curved fashion, slightly resembling the letter "C."

According to one embodiment of the present invention, the first end region may be designed on the first sidepiece and the second end region as well as the contact area are designed on the second sidepiece of the "V."

According to one embodiment of the present invention, the second sidepiece of the "V" may deviate against an elastic reset force on the first sidepiece. In other words, an insertion of the plug into the socket leads to a deviation of the second sidepiece of the "V" toward the first sidepiece. If the suitable material and appropriate dimensions are selected, the deviation lies exclusively in the elastic area, whereas a plastic deformation does not occur.

Additionally or alternatively, the first sidepiece of the "V" may also deviate radially outwards around the first end region against an elastic reset force. Insertion of the plug into the socket leads to a deviation of the first sidepiece of the "V" toward the second sidepiece. This deviation also lies in the elastic area, if the suitable material and appropriate dimensions are selected.

Even in case of larger transversal displacements of the plug with respect to the socket, a sufficient contacting may be ensured, particularly if the deviation of both the sidepieces against one another as well as the deviation of the first sidepiece around the first end region are used for generating the reset force that brings about the contact.

According to one embodiment of the present invention, the contact area may be designed in the area connecting both the sidepieces of the "V." According to one configuration, both the sidepieces are deviated towards one another against an elastic reset force. In other words, the "V" is pre-stressed in the direction of the decrease in the opening angle. Such a pre-stressing force is useful for ensuring electrical contact of the contact elements with a possible cabling of the socket.

According to one embodiment of the present invention, the connecting area of the "V" may be displaced radially outwards against an elastic reset force. In this embodiment, this elastic reset force serves to maintain contact when the plug is inserted into the socket.

In order to provide electrical contact of the contact elements with a possible cabling of the socket, a pressing device may be provided in addition to or as an alternative to the above-mentioned measures according to various embodiments of the present invention. Said pressing device serves for pressing the first and/or the second end region on a contact surface. In other words, the present invention according to this embodiment does not rely on an elasticity of the contact element. Rather, the contact element is pressed by the pressing device against the contact surface.

According to various embodiments of the present invention, it proves to be particularly easy from the mechanical point of view if the pressing device exerts an elastic reset force against a lift-off of the first and/or the second end region from the contact surface.

According to various embodiments of the present invention, the pressing device preferably has a spring.

Furthermore, according to various embodiments of the present invention, the pressing device preferably rests on one side against the first or the second end region and on the other side against a counterbearing. In one embodiment, it is possible to use the pressing device for conducting electricity, particularly if it is conductive and if the counterbearing represents a path for the electricity to be conducted.

Moreover, according to various embodiments of the present invention, both the end regions may be displaced in the radial direction. In other words, in this solution, none of the two end regions serve for designing the counterbearing for accepting reset forces.

In an embodiment, the socket comprises at least two contact elements that extend radially and outward around an elastic ring. Here, it may be pointed out emphatically that the elastic ring does not necessarily have to be circular in shape, but it may. The use of many other geometric shapes is also possible, for example, an oval or an elliptical design.

However, in any case, the elastic ring serves for generating the aforementioned reset force when the connecting area is displaced radially outwards. Since a closed contour, namely said elastic ring, is used in this embodiment, no additional counterbearing with respect to the elastic reset force is necessary. Therefore, the contact elements need not be fixably attached in the socket. Rather, they may lie in a virtually 'floating' manner in the socket at least with respect to their displacement in the radial direction. Thus the force that is available for the contacting of the contact elements with the plug is completely independent of any radial displacements of the plug inside the socket.

According to various embodiments of the present invention, the contact element is preferably a segment.

In addition to the socket, embodiments of the present invention also create a plug connector having a plug as well as a socket as described above in detail.

Lastly, according to various embodiments of the present invention, an insertion opening of the socket is preferably dimensioned in such a manner that the plug fits into it with a radial clearance. Thus it is possible for the plug to be displaced radially with respect to the socket. This displacement characteristic proves to be greatly advantageous in many applications.

BRIEF DESCRIPTION OF THE DRAWINGS

The invention is explained more elaborately and with additional details in the following description, based on exemplary embodiments, but not limitations, and with reference to the accompanying drawings in which like references denote similar elements, which show the following.

DETAILED DESCRIPTION

Figure 1A:
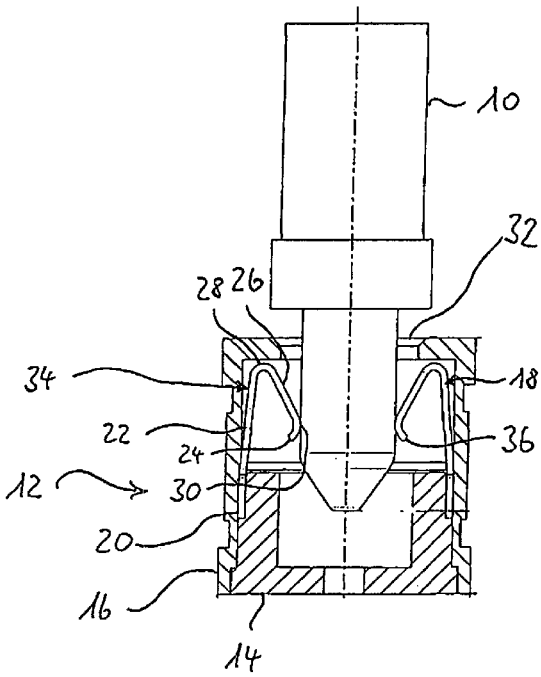
FIG. 1A and FIG. 1B illustrate schematic cross-sectional views from a side of a first embodiment of the present invention in different operational states.

In the following detailed description, reference is made to the accompanying drawings which form a part hereof wherein like numerals designate like parts throughout, and in which are shown, by way of illustration, specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification do not necessarily all refer to the same embodiment, but they may. The phrase "A/B" means "A or B". The phrase "A and/or B" means "(A), (B), or (A and B)". The phrase "at least one of A, B and C" means "(A), (B), (C), (A and B), (A and C), (B and C) or (A, B and C)". The phrase "(A) B" means "(A B) or (B)", that is "A" is optional.

The plug connector illustrated in FIG. 1 comprises a plug 10 as well as a socket 12. The socket 12 includes a support 14 as well as a sleeve 16. Furthermore, the socket also includes several segments, only two of which are illustrated in FIG. 1 as an example. One of these segments is marked with the reference numeral 18. Each of the segments has a first end region 20 on a first sidepiece 22 and a second end region 24 on a second sidepiece 26. Both the sidepieces 22 and 26 are connected to one another over a connecting area 28. Close to the second end region 24, a contact area 30 is designed on the second sidepiece 26 that rests against the plug 10.

FIG. 1A illustrates the plug 10 inserted into the socket 12 in a position in which the plug is centered with respect to an insertion opening 32.

Figure 1B:
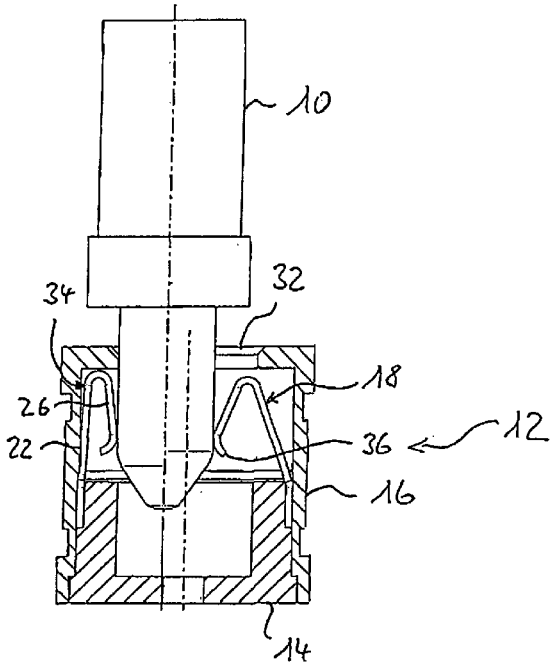

In FIG. 1B, an operational state is illustrated in which the plug 10 is displaced to the left with respect to the insertion opening 32. Accordingly, both the segments 18 and 34 are also displaced. In particular, the second end region 24 of the left segment 34 is displaced to the left. The same applies to the segment 18 and the second end region 36 in FIG. 1B.

As a result of the displacement of the plug 10 inside the insertion opening 32, the left segment 34 deviates or swivels counter-clockwise to the first end region 20 in FIG. 1B. Furthermore, both the sidepieces 22 and 26 are drawn closer to one another. A reciprocal deformation to the one mentioned above occurs in the case of the segment 18 illustrated in FIG. 1B. The segment 18 continues to press against the outer casing or surface of the plug 10 with sufficient force to maintain contact. Since the second end region 36 of the segment 18 is radially displaceable, the entire segment 18 may follow the displacement to the left of the plug 10 as illustrated in FIG. 1B and may ensure contact with the plug 10.

Figure 2B:
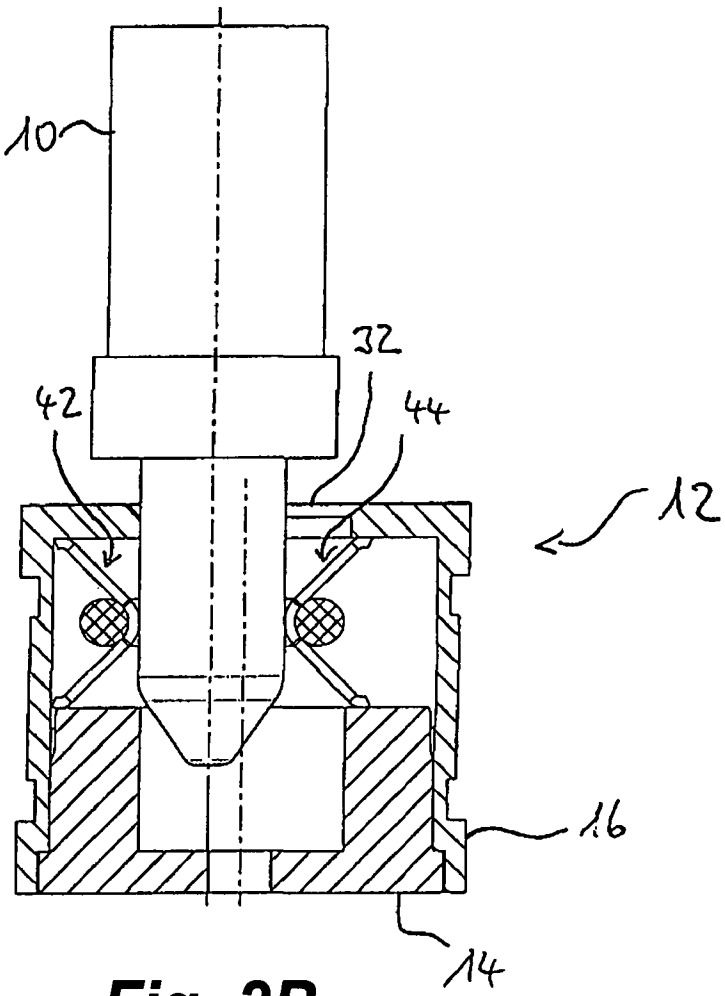
FIG. 2A and FIG. 2B illustrate schematic cross-sectional views from a side of a second embodiment of the present invention in different operational states.
Figure 2A:
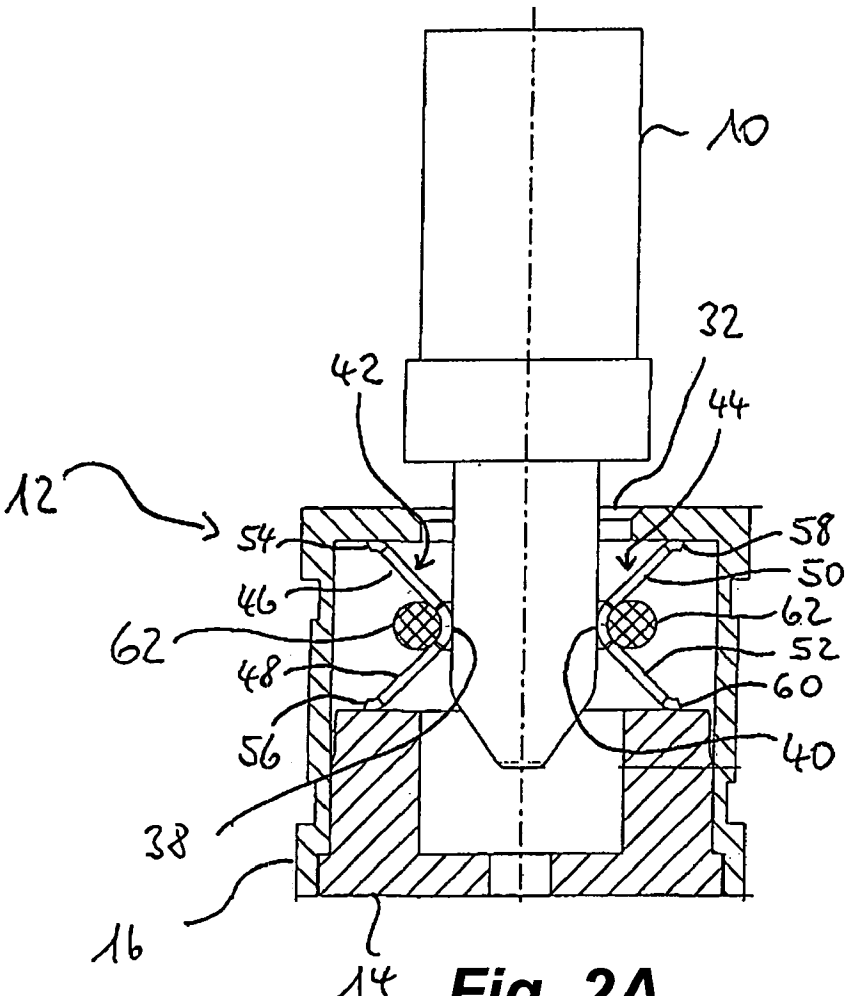

In the embodiment illustrated in FIG. 2, contact areas 38 and 40 of segments 42 and 44 do not lie close to the respective end regions 54, 56 and/or 58, 60, but instead lie in the connecting area of the two sidepieces 46, 48 and/or 50, 52. Here, the support 14 and the sleeve 16 press both the segments 42 and 44 together in the axial direction against an elastic reset force. The result is a reliable contact of the segments 42 and 44 with the support 14 and the sleeve 16 for the transmission of electrical signals. However, incidentally, both the segments 42 and 44 and particularly their end regions 54, 56, 58, 60 are displaceable in the radial direction with respect to the support 14 and the sleeve 16. To press the segments 42 and 44 against the plug 10, an elastic ring 62 is used that expands against its elastic reset force when the plug 10 is inserted. Thus, the contact force is completely independent of the transversal displacement of the plug 10 inside the insertion opening 32. A ring similar to the ring 62 on the outer side of the contact area 30 may also be provided in various embodiments, as illustrated in FIG. 1.

As is apparent from a synopsis of both the sides of FIG. 2, relative position of the plug 10 with respect to the segments 42 and 44 does not change in a case of a transversal displacement of the plug with respect to the insertion opening 32, nor does the state of both the segments 42 and 44 undergo a change apart from a transversal displacement.

The embodiment illustrated in FIG. 3 is very similar to that of FIG. 2. Hence, only the differences are specified in the following description. Contact areas 64 and 66 of segments 68 and 70 also neither lie close to nor symmetrical to the respective end regions 72, 74, 76 and 78 of sidepieces 80, 82, 84 and 86 of the segments 68 and 70. Rather, the sidepieces 80 and 84 are shorter than the sidepieces 82 and 86. However, the "V" shape may be realized if the contact areas 64 and 66 lie on the respective apex of the "V." Particularly, the sidepieces 82 and 86 are provided with a curved design instead of a straight design. As specified above, the "V" shape refers to any design form comprising a contact area, which lies radially in the innermost part of the segment.

An additional difference in the embodiment illustrated in FIG. 3 as compared to that in FIG. 2 is that a spring 88 is provided that is supported on one side against the end regions 74 and 78 of the segments 68 and 70 and on the other side against an inner surface 90 of the sleeve 16. Said inner surface of the sleeve serves as a counterbearing. Since the spring 88 is a pressure spring, the end regions 74 and 78 of the segments 68 and 70 are reliably pressed against an inner surface 92 of the support 14. Said inner surface of the support serves as a contact surface. This ensures a reliable electrical contact. Another factor that contributes to ensuring the electrical contact is that the spring 88 also is made of a conductive material (for example, steel) so that electricity may flow through the spring and also the sleeve 16.

Similar to the reset force of the segments 42 and 44 illustrated in FIG. 2 that is attributed to inherent elasticity, the spring 88 illustrated in FIG. 3 also is not opposed to a transversal displacement of the plug in the socket when maintaining the electrical contact.

Figure 3B:
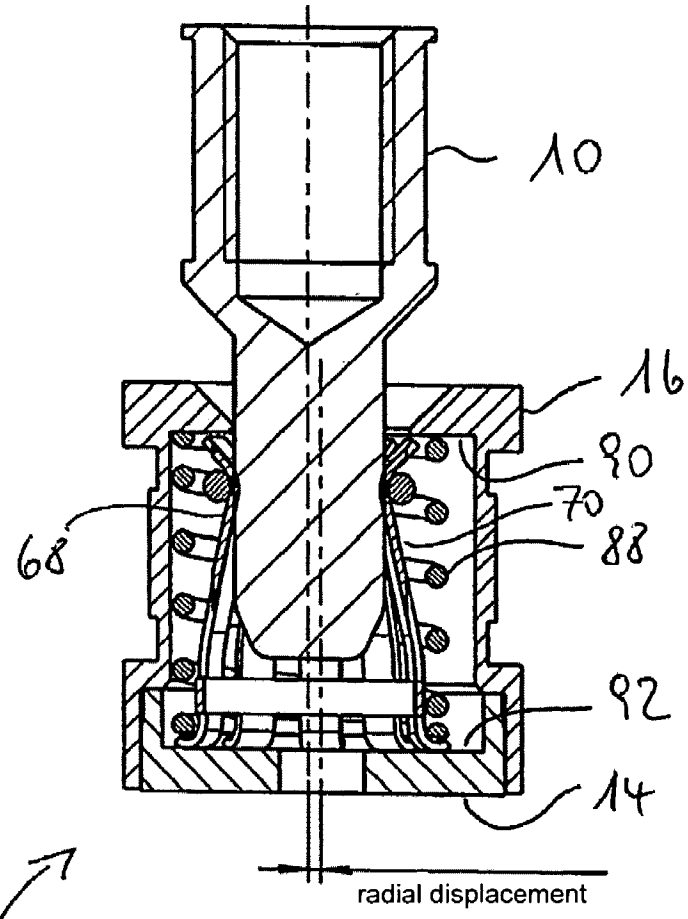
FIG. 3A and FIG. 3B illustrate schematic cross-sectional views from a side of a third embodiment of the present invention in different operational states.
Figure 3A:
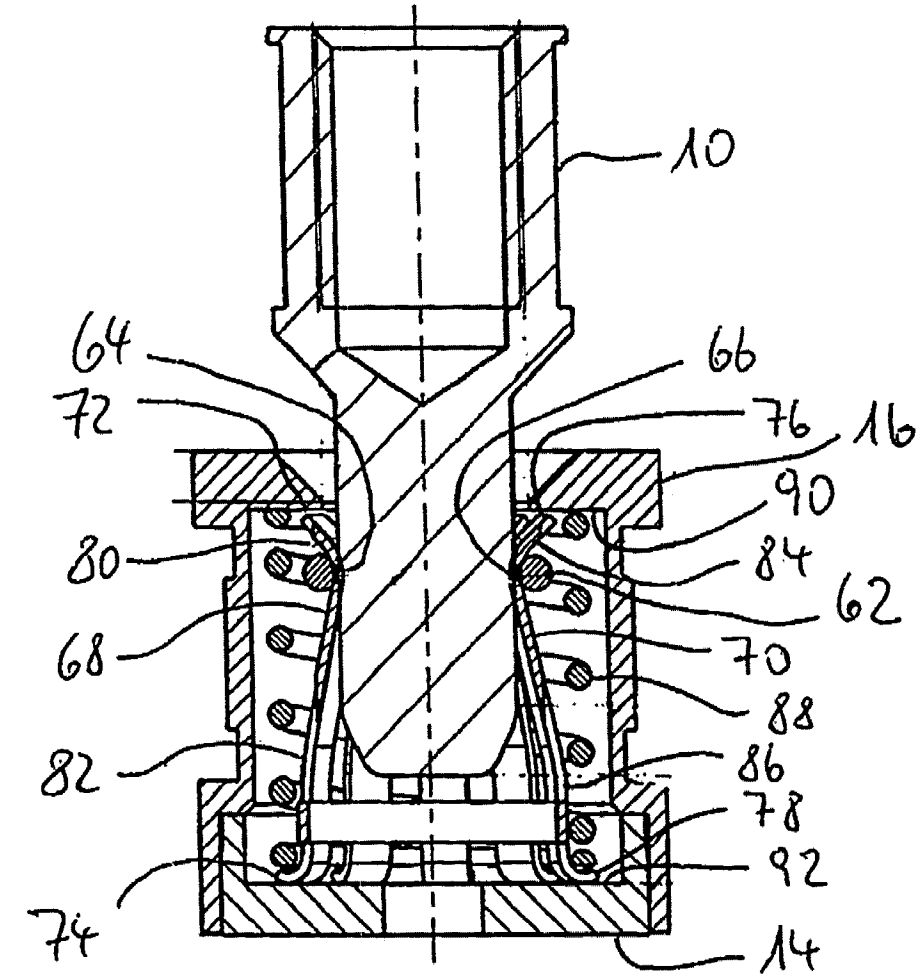
Figure 4:
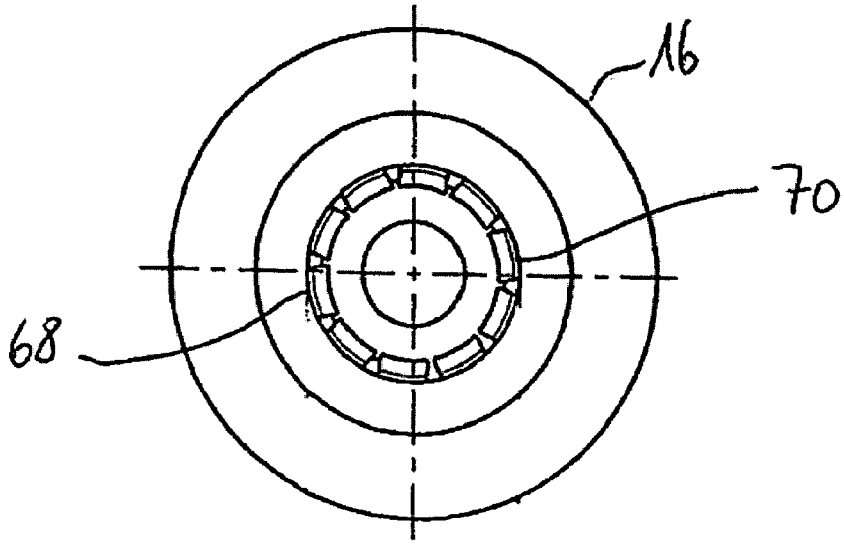
FIG. 4 illustrates a perspective top view of the embodiment illustrated in FIG. 3A, however without a pin.

In the operational state illustrated in FIG. 3B, the plug 10 is displaced to the left as compared to the operational state illustrated in FIG. 3A.

This application claims the benefit, under 35 USC § 119 of prior German Patent Application 102004053332.6 filed Nov. 4, 2004, and European Patent Application 05020269.6 filed Sep. 16, 2005. The entire disclosures of these prior applications are incorporated herein by reference in their entirety.

To sum up, it may be maintained that the socket according to various embodiments of the present invention as well as the electrical connector according to embodiments of the present invention allow a transversal displacement of a plug with respect to the socket without adversely affecting the electrical contact.

The characteristics of the present invention disclosed in the above description, the claims, as well as the drawings, may be used both individually as well as in any combination for implementing the present invention in its various embodiments.

What is claimed is:

1. A socket of an electrical connector, comprising:

at least one flexible contact element having a first end region, a contact area configured for electrical contact with a plug, and a second end region;

a pressing device, for pressing the first and/or the second end region against a contact surface of the socket in an axial direction; and both end regions are displaceable in a radial direction when the plug is inserted into the socket.

2. The socket as recited in claim 1, wherein the pressing device exerts a reset force against a lift-off of the first and/or the second end region from the contact surface.

3. The socket as recited in claim 1, wherein the pressing device has a spring.

4. The socket as recited in claim 1, wherein the pressing device rests on one side against the first or second end region and against a counter bearing on the other.

5. The socket as recited in claim 1, further comprises at least two contact elements around which an elastic ring extends radially outwards.

6. The socket as recited in claim 1, wherein the contact element is a segment.

7. The socket as recited in claim 1, wherein the contact element is V-shaped.

8. The socket as recited in claim 7, wherein the contact area is designed in the area connecting both the sidepieces of the V-shaped contact element.

9. The socket as recited in claim 8, wherein both the sidepieces deviate towards one another against an elastic reset force.

10. The socket as recited in claim 8, wherein the connecting area of the V-shaped contact element displaces radially outwards against an elastic reset force.

11. A plug connector, comprising:

a plug; and a socket of an electrical plug connector having at least one flexible contact element having a first end region, a second end region, and a contact area configured for electrical contact with the plug, and a pressing device for pressing the first and/or the second end region against a contact surface of the socket in an axial direction, both the end regions being displaceable in a radial direction when the plug is inserted into the socket.

12. A plug connector, comprising:

a plug; and a socket of an electrical plug connector having at least one flexible contact element, the contact element having a first end region, a contact area for electrical contact with the plug, and a second end region, both the end regions being displaceable in a radial direction when the plug is inserted into the socket, the socket having an insertion opening dimensioned in such a manner that the plug fits into the socket with a radial clearance, and the socket having a pressing device for pressing the first and/or the second end region against the contact surface of the socket in an axial direction.

* * * * *